US008958596B2

(12) United States Patent
Chu

(10) Patent No.: US 8,958,596 B2
(45) Date of Patent: Feb. 17, 2015

(54) VIBRATION SYSTEM AND SPEAKER USING THE SAME

(71) Applicant: Zhuming Chu, Shenzhen (CN)

(72) Inventor: Zhuming Chu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/217,611

(22) Filed: Mar. 18, 2014

(65) Prior Publication Data

US 2015/0023544 A1 Jan. 22, 2015

(30) Foreign Application Priority Data

Jul. 22, 2013 (CN) ..... 2013 2 0436642

(51) Int. Cl.
*H04R 1/00* (2006.01)
*H04R 9/02* (2006.01)
*H04R 7/16* (2006.01)

(52) U.S. Cl.
CPC ..... *H04R 9/022* (2013.01); *H04R 9/025* (2013.01); *H04R 7/16* (2013.01)
USPC ..... 381/397; 381/400

(58) Field of Classification Search
USPC ..... 381/397, 396, 400–402; 181/198, 199
See application file for complete search history.

(56) References Cited

U.S. PATENT DOCUMENTS

| | | | | |
|---|---|---|---|---|
| 4,590,332 | A * | 5/1986 | Delbuck | 381/397 |
| 2007/0201718 | A1* | 8/2007 | Shimoe et al. | 381/396 |
| 2008/0025549 | A1* | 1/2008 | Avera | 381/397 |
| 2008/0075317 | A1* | 3/2008 | Chen et al. | 381/397 |
| 2008/0304694 | A1* | 12/2008 | Hayashi | 381/397 |

* cited by examiner

*Primary Examiner* — Tuan D Nguyen
(74) *Attorney, Agent, or Firm* — IPro, Inc.; Na Xu

(57) ABSTRACT

A vibration system is disclosed. The vibration system includes a diaphragm and a voice coil that drives the diaphragm to vibrate. The diaphragm includes a fixing part for fixing the voice coil, and a heat sink is disposed on and fixed to the fixing part. A speaker using the vibration system is also disclosed. By disposing the heat sink on the diaphragm, heat can be dissipated from the voice coil effectively to ensure stability of the speaker.

9 Claims, 3 Drawing Sheets

VIBRATION SYSTEM AND SPEAKER USING THE SAME

FIELD OF THE INVENTION

The present disclosure generally relates to the technical field of electro-acoustic transducers, and more particularly, to a vibration system used in the electro-acoustic transducer, and to a speaker using the same.

DESCRIPTION OF RELATED ART

Speakers are known as important components in modern electronic products having a multimedia function, and vibration systems in the speakers have a great influence on the acoustic performance and the stability of the speakers. Generally a vibration system comprises a diaphragm and a voice coil that drives the diaphragm to make sounds by vibration of the diaphragm. The voice coil is suspended in a magnetic gap of a magnetic circuit unit. When the vibration system is vibrated, heat will be generated by the voice coil that is energized. Because the vibration space is so limited, the heat is accumulated to cause overheating. Further, the accumulated heat is transferred to the diaphragm and weakens the stiffness or strength of the diaphragm. This will further compromise the acoustic performance and stability of the speaker.

Accordingly, there is a need to provide a new kind of vibration system that can timely dissipate the heat produced by the voice coil.

DETAILED DESCRIPTION OF AN EXEMPLARY EMBODIMENT OF THE INVENTION

Hereinafter, the present disclosure will be further described with reference to the attached drawings and an exemplary embodiment thereof.

Figure 1:
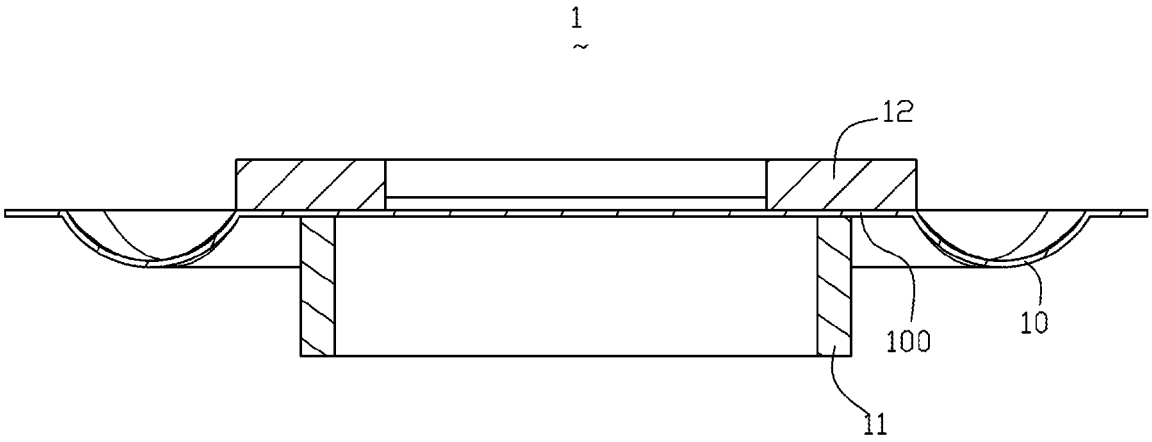
FIG. 1 is a cross-sectional view of a vibration system according to the present disclosure.
Figure 2:
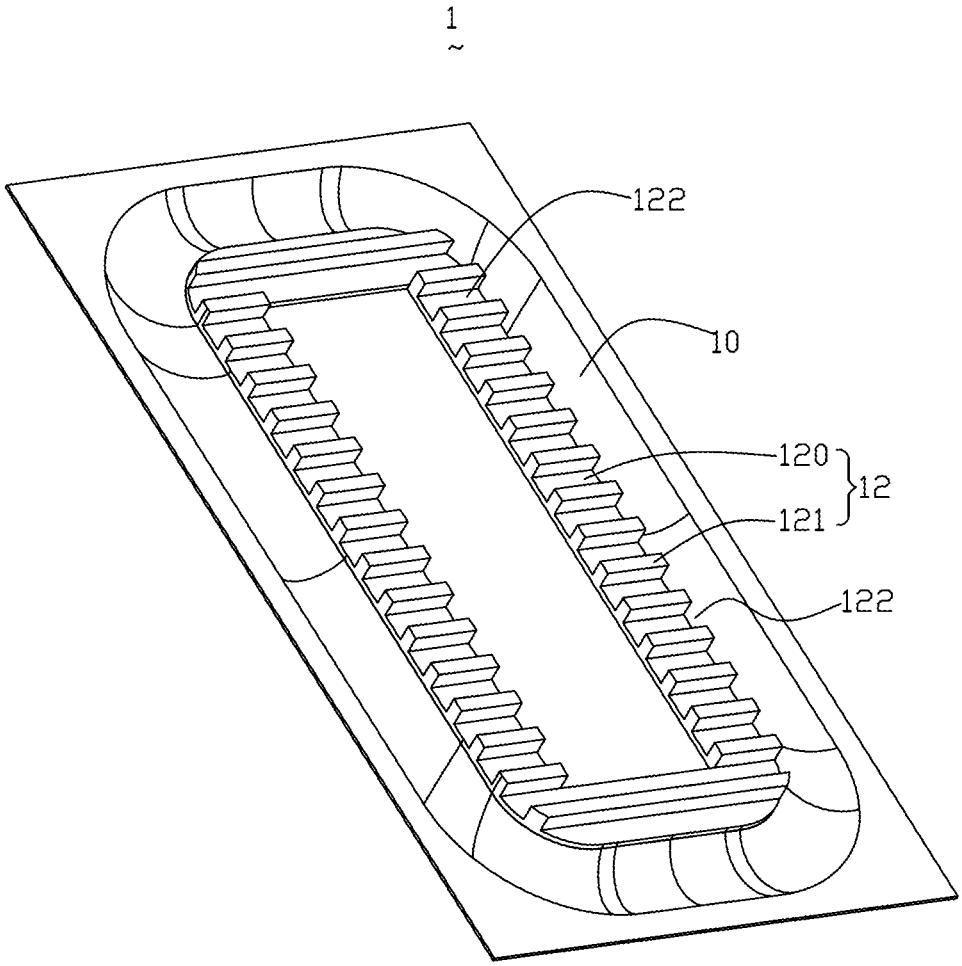
FIG. 2 is a perspective view of the vibration system shown in FIG. 1.

As shown in FIG. 1 and FIG. 2, the exemplary embodiment of the present disclosure provides a vibrating system 1, which comprises a diaphragm 10 and a voice coil 11 attached to the diaphragm 10 directly or indirectly that drives the diaphragm 10 to vibrate for generating sounds. The vibrating diaphragm 10 is provided thereon with a fixing part 100 for attaching with the voice coil 11, by which the diaphragm 10 is assembled with the voice coil 11. In this embodiment, the diaphragm 10 is directly attached with the voice coil 11. Optionally, the diaphragm 10 may be assembled with the voice coil 11 via a medium. The vibration system 1 further includes a heat sink 12 which is disposed on and fixed to the fixing part 100. The voice coil 11 is attached to the diaphragm 10 on a lower surface thereof, and the heat sink 12 is attached to the diaphragm 10 on an upper surface thereof. Another word, the fixing part 100 is sandwiched between the heat sink 12 and the voice coil 11.

As an optional configuration, the heat sink 12 in the exemplary embodiment is a heat dissipating fin made of aluminum (Al) because Al can dissipate heat easily and has a lightweight and a high stiffness. Therefore, the heat dissipating fin has little influence on the overall weight of the vibration system 1.

Use of the heat dissipating fin can increase the surface area of the heat sink 12. The heat sink 12 matches in shape with the fixing part 100, and comprises a substrate 120 fixed to the fixing part 100 and a plurality of protrusions 121 extending from the substrate 120 and disposed in an array. The protrusions 121 are spaced apart from each other equidistantly on the substrate 120 in an array form, and are disposed parallel to each other, and a heat dissipating channel 122 is disposed between every two adjacent protrusions 121.

Figure 3:
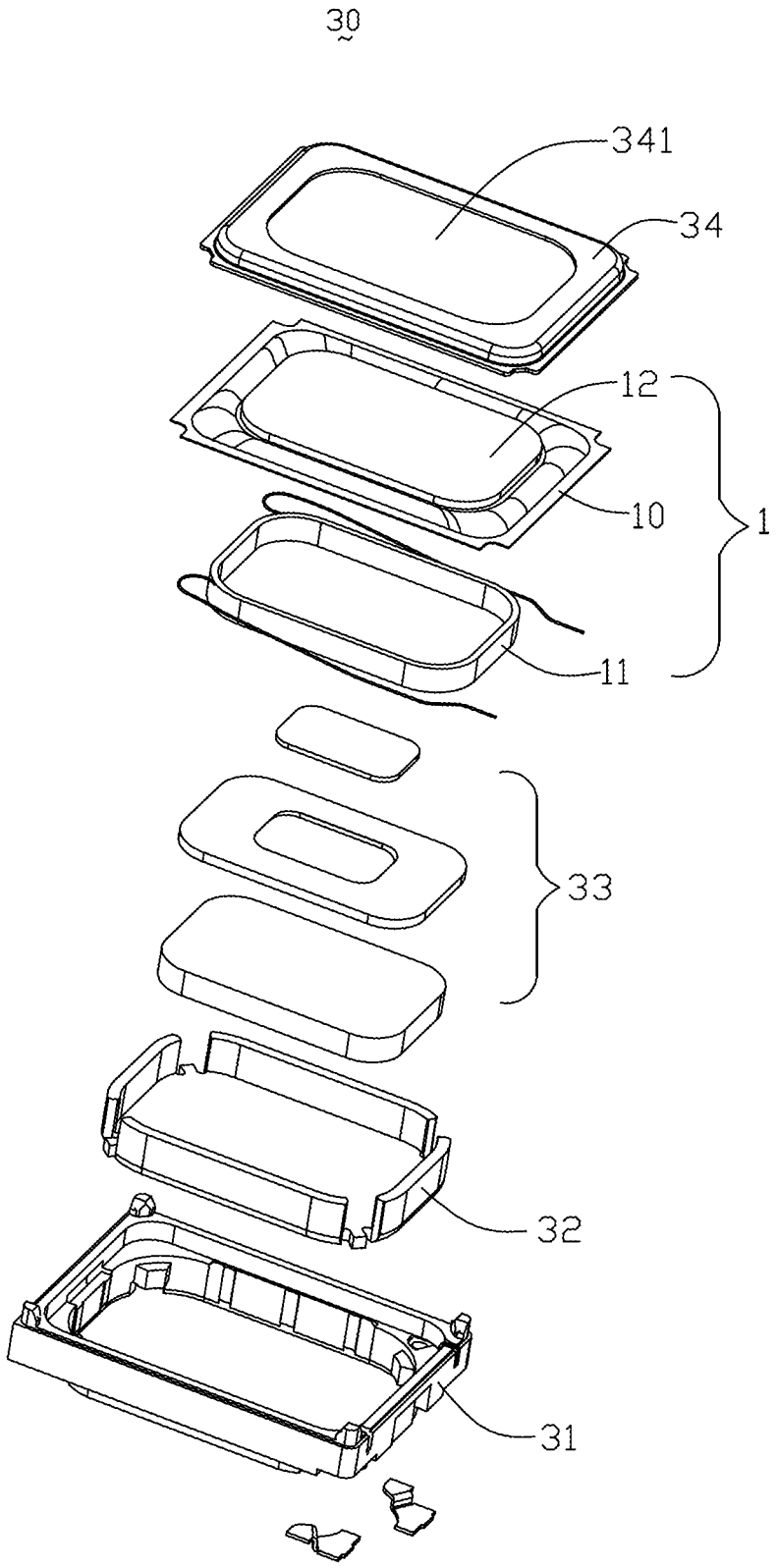
FIG. 3 is an isometric exploded view of a speaker using the vibration system in FIG. 1.

Referring to FIG. 3, a speaker 30 using the vibration system 1 described above is also disclosed. The speaker 30 includes a frame 31, a magnetic yoke 32 supported by the frame 31, a magnetic circuit unit 33 including a magnet and a pole plate on the magnet, a vibration system 1, and a front cover 34. While assembled, the yoke 32 is positioned by the frame 31, and the magnetic circuit unit 33 is supported by the magnetic yoke 32. The vibration system 1 includes a diaphragm 10, a voice coil 11 driving the diaphragm 10, and a heat sink 12 attached to the diaphragm 10. The diaphragm 10 is sandwiched by the heat sink 12 and the voice coil 11. The heat sink 12 is positioned on the diaphragm 10 for covering and contacting a joint part of the diaphragm 10 and the voice coil 11. Further, the front cover 34 forms an opening 341 accommodating the heat sink 12. Heat produced by the voice coil 11 is transferred to the heat sink 12 via the diaphragm 10, and is dissipated outside via the opening 341.

What described above are only exemplary embodiment of the present disclosure. It shall be appreciated that, for those of ordinary skill in the art, modifications may be made thereto without departing from the inventive concepts of the present disclosure, and all these modifications shall fall within the scope of the present disclosure.

What is claimed is:

1. A vibration system, comprising:

a diaphragm having a fixing part;

a voice coil connected with the diaphragm and driving the diaphragm to vibrate;

a heat sink disposed on the diaphragm, and contacting a joint part of the diaphragm and the voice coil;

the vibrating diaphragm being sandwiched between the voice coil and the heat sink.

2. The vibration system of claim 1, wherein the heat sink is a heat dissipating fin.

3. The vibration system of claim 2, wherein the heat sink comprises a substrate fixed to the fixing part, and a plurality of protrusions extending from the substrate and disposed in an array.

4. The vibration system of claim 3, wherein the protrusions are disposed parallel to each other for forming a plurality of heat dissipating channels between adjacent protrusions.

5. A speaker, comprising:

a frame;

a magnetic yoke supported by the frame;

a magnetic circuit unit positioned by the magnetic yoke;

a vibration system driven by the magnetic circuit unit; wherein the vibration system comprises:

a diaphragm having a fixing part;

a voice coil connected with the diaphragm and driving the diaphragm to vibrate;

a heat sink disposed on the diaphragm, and contacting a joint part of the diaphragm and the voice coil;

the vibrating diaphragm being sandwiched between the voice coil and the heat sink.

6. The speaker of claim 5, further comprising a front cover having an opening for accommodating the heat sink.

7. The speaker of claim 5, wherein the heat sink is a heat dissipating fin.

8. The speaker of claim 7, wherein the heat sink comprises a substrate fixed to the fixing part, and a plurality of protrusions extending from the substrate and disposed in an array.

9. The speaker of claim 8, wherein the protrusions are disposed parallel to each other for forming a plurality of heat dissipating channels between adjacent protrusions.

* * * * *